US008409055B2

(12) United States Patent
Gooden et al.

(10) Patent No.: US 8,409,055 B2
(45) Date of Patent: Apr. 2, 2013

(54) POWERTRAIN THERMAL MANAGEMENT SYSTEM

(75) Inventors: James Thomas Gooden, Canton, MI (US); Donald Peter Schneider, Commerce Township, MI (US); Kenneth Gerald Brown, Shelby Township, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 689 days.

(21) Appl. No.: 12/616,741

(22) Filed: Nov. 11, 2009

(65) Prior Publication Data

US 2011/0111920 A1 May 12, 2011

(51) Int. Cl.

| | |
|---|---|
| ***B60H 1/00*** | (2006.01) |
| ***B60H 1/03*** | (2006.01) |
| ***B61D 27/00*** | (2006.01) |
| ***F16H 59/00*** | (2006.01) |

(52) U.S. Cl. ..... 477/98; 165/41; 237/5; 237/12.3 R; 237/12.4

(58) Field of Classification Search ..... 477/97, 477/98; 165/41–44; 237/2 A, 5, 12.3 R–12.3 C, 237/12.4–12.8

See application file for complete search history.

(56) References Cited

U.S. PATENT DOCUMENTS

| | | | | |
|---|---|---|---|---|
| 4,457,284 | A * | 7/1984 | Salzgeber | 123/502 |
| 5,024,377 | A * | 6/1991 | Harrison | 237/2 A |
| 6,454,180 | B2 * | 9/2002 | Matsunaga et al. | 237/12.3 B |
| 6,520,136 | B2 | 2/2003 | Ito et al. | |
| 6,695,743 | B2 | 2/2004 | Tanaka et al. | |
| 8,205,709 | B2 * | 6/2012 | Gooden et al. | 180/339 |
| 2009/0000577 | A1 | 1/2009 | Miyagawa | |
| 2009/0101312 | A1 | 4/2009 | Gooden et al. | |
| 2011/0067389 | A1 * | 3/2011 | Prior et al. | 60/320 |

FOREIGN PATENT DOCUMENTS

| | | | |
|---|---|---|---|
| JP | 2002364362 | | 12/2002 |
| JP | 2004360460 | | 12/2004 |
| JP | 2004360460 | A * | 12/2004 |
| JP | 2005003134 | | 1/2005 |
| JP | 2006283872 | | 10/2006 |

* cited by examiner

*Primary Examiner* — Tisha Lewis

(74) *Attorney, Agent, or Firm* — James J. Dottavio; Just Intellectuals, PLLC

(57) ABSTRACT

A thermal management system for a vehicle powertrain includes a heater core, a transmission fluid warmer selectively in thermal communication with the heater core, a bypass valve between the heater core and transmission fluid warmer configured to control fluid flow therebetween, a control module configured to control the bypass valve, and a timer linked to the control module configured to delay deactivation of the bypass valve.

9 Claims, 7 Drawing Sheets

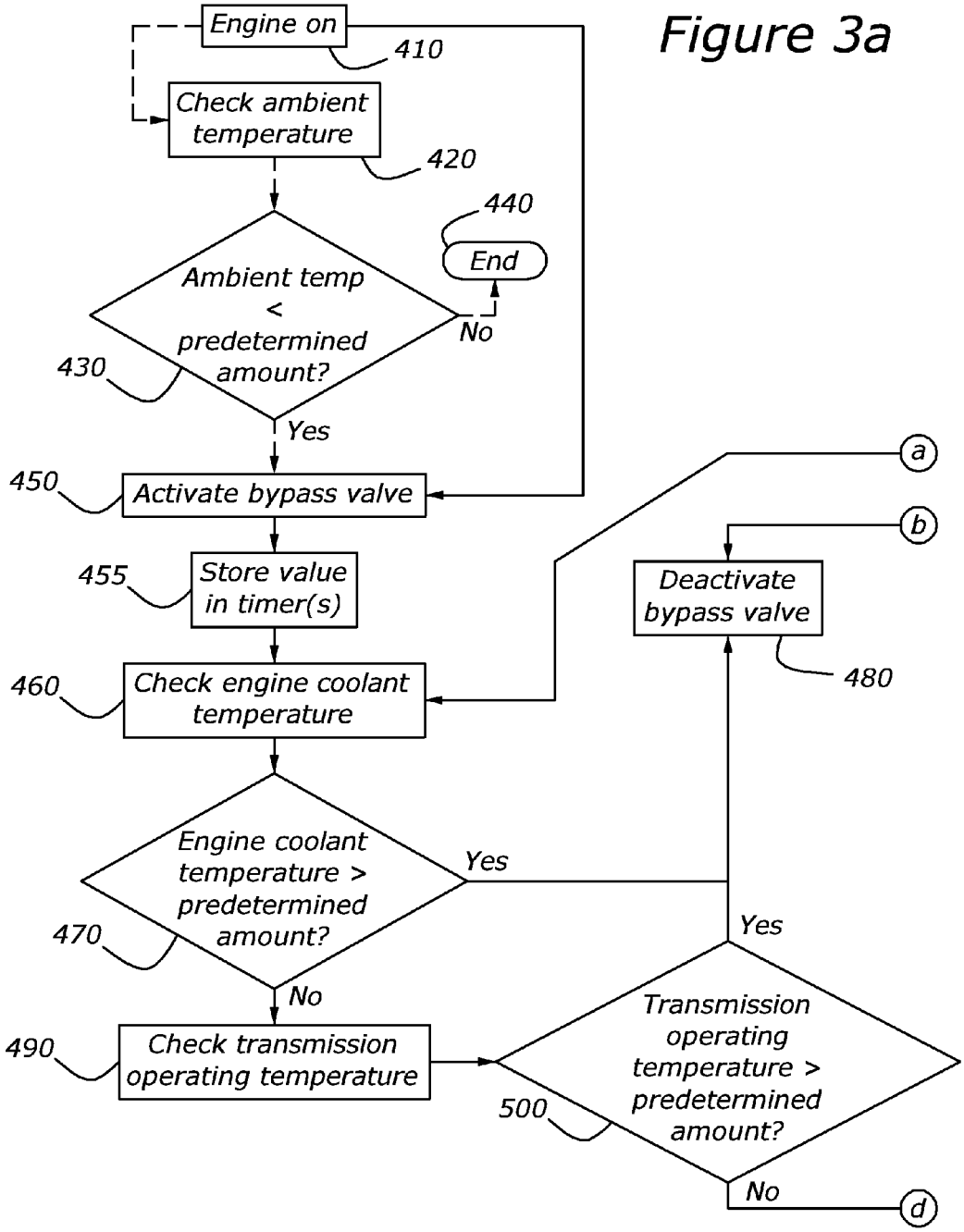
Figure 3a
Engine on
410
Check ambient temperature
420
440
End
Ambient temp < predetermined amount?
No
430
Yes
450
Activate bypass valve
455
Store value in timer(s)
460
Check engine coolant temperature
a
b
Deactivate bypass valve
480
Engine coolant temperature > predetermined amount?
Yes
470
No
Yes
490
Check transmission operating temperature
Transmission operating temperature > predetermined amount?
500
No
d

POWERTRAIN THERMAL MANAGEMENT SYSTEM

TECHNICAL FIELD

The present disclosure relates to thermal management systems for a vehicle powertrain. More specifically, discussed herein is control logic for a bypass valve between an engine heater core and an automatic transmission fluid warmer.

BACKGROUND

Conventional automobile powertrains require thermal management to make the most efficient use of the thermal energy therein. Most vehicles include a heater core in thermal communication with a vehicle engine. A transmission fluid warmer can be used to add heat to the transmission particularly when starting the vehicle or operating in park or lower gears. In some instances, the transmission fluid warmer can receive thermal energy from the engine through coolant circulated through the heater core. In doing so, heating of the transmission fluid is expedited.

Faster automatic transmission fluid warming is desirable to improve fuel economy. Pulling heat from the cooling circuit to heat the transmission fluid can lead to problems. One problem created by this method is that heater performance can be negatively impacted. To reduce such impact on heater performance, a bypass valve can be installed to selectively avoid flowing fluid through the automatic transmission fluid warmer. The bypass valve can be used when heater performance is a priority and turned off when fuel economy is a priority. When considering the trade-offs made in controlling the valve, designing the valve controls can be particularly nuanced.

One existing design includes the use of a vehicular lockup clutch-equipped transmission control apparatus which is described as reducing deterioration of heating capability and improving fuel efficiency. U.S. Pat. No. 6,695,743 titled "Vehicular lockup clutch-equipped transmission control apparatus and control method thereof" discloses a flow control valve that is controlled by the engine control unit. In response to various temperature readings, the system sets the lockup region for the clutch to provide a desired fuel economy and heating capability. While these types of systems can improve fuel efficiency they can also heat the transmission fluid during unwanted periods of time and direct heat away from the engine at undesirable points.

Therefore, it is desirable to have a thermal management system for a vehicle powertrain with improved thermal management and fuel efficiency.

SUMMARY

The present invention(s) may address one or more of the above-mentioned issues. Other features and/or advantages may become apparent from the description which follows.

One exemplary embodiment of the present invention provides a thermal management system for a vehicle powertrain that includes: a heater core; a transmission fluid warmer selectively in thermal communication with the heater core; a bypass valve between the heater core and transmission fluid warmer configured to control fluid flow therebetween; a control module configured to control the bypass valve; a timer linked to the control module, configured to delay deactivation of the bypass valve; and a temperature sensor linked to the control module, configured to assess an engine coolant temperature. The control module is configured to deactivate the bypass valve when engine coolant temperature is greater than a predetermined amount. The control module is configured to set the timer when a rate of engine coolant temperature change is less than a predetermined amount.

Another exemplary embodiment of the present invention provides a control module for a transmission thermal management system that includes a processor linked to a vehicle system. The processor is configured to control a fluid bypass valve between a transmission fluid warmer and a heater core, the processor including a timer is configured to implement a delayed deactivation of the bypass valve. The control module is configured to set the timer when an indicator is detected indicating that a radiator thermostat valve is at least partially open.

Yet another exemplary embodiment of the present invention provides a method of heating transmission fluid in a vehicle. The method includes: routing fluid from a heater core to a transmission fluid warmer; selectively bypassing the fluid from the heater core; and controlling bypass of the fluid with temporal limitations on the operation of a bypass valve. At least one temporal limitation is related to a vehicle performance characteristic.

One advantage of the present teachings is a thermal management system that includes a bypass valve with timer configured to delay deactivation of the bypass valve. The timer enables more flexible thermal management.

Another advantage of the present teachings is that the timer can be triggered by a number of criteria. For example, where a rate of engine coolant temperature change is less than a predetermined amount the timer can be set. Such vehicle performance characteristics can serve as system inputs indicating the appropriate instances to deactivate the bypass valve.

In the following description, certain aspects and embodiments will become evident. It should be understood that the invention, in its broadest sense, could be practiced without having one or more features of these aspects and embodiments. It should be understood that these aspects and embodiments are merely exemplary and explanatory and are not restrictive of the invention.

The invention will be explained in greater detail below by way of example with reference to the figures, in which the same references numbers are used in the figures for identical or essentially identical elements. The above features and advantages and other features and advantages of the present invention are readily apparent from the following detailed description of the best modes for carrying out the invention when taken in connection with the accompanying drawings. In the figures:

BRIEF DESCRIPTION OF THE DRAWINGS

FIGS. 3*a-b* illustrate control logic for an exemplary thermal management system.

Figure 1:
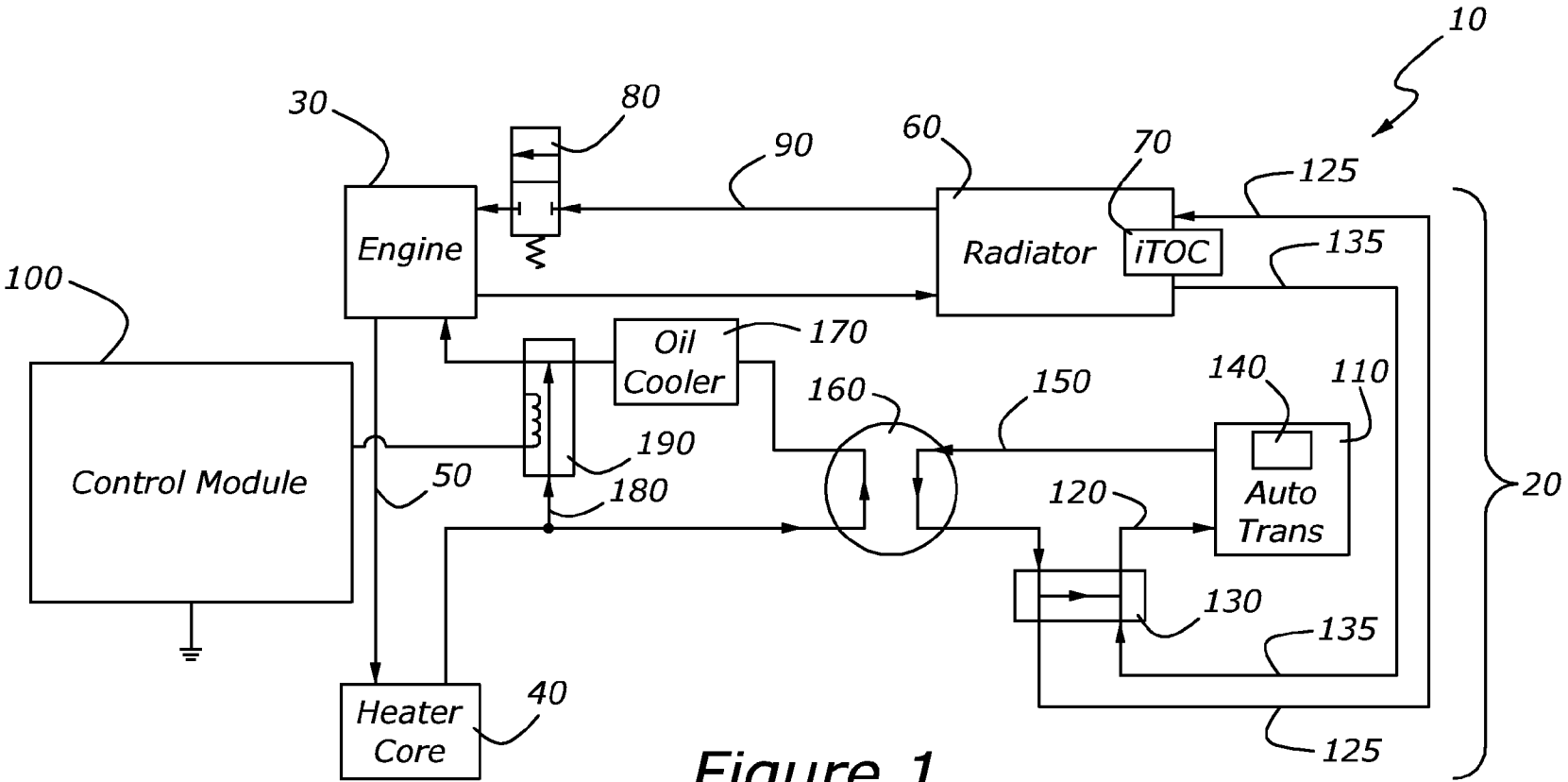
FIG. 1 illustrates a vehicle powertrain with a thermal management system according to an exemplary embodiment of the present invention.

Although the following detailed description makes reference to illustrative embodiments, many alternatives, modifications, and variations thereof will be apparent to those skilled in the art. Accordingly, it is intended that the claimed subject matter be viewed broadly.

DETAILED DESCRIPTION

Referring to the drawings, FIGS. 1-6, wherein like characters represent the same or corresponding parts throughout the several views there is shown various exemplary thermal management systems for a vehicle powertrain. The provided thermal management systems include a bypass valve that regulates coolant flow between an engine heater core and a transmission fluid warmer. The bypass can be instantly activated and deactivated or operate on a delayed activation or deactivation. A control module is provided with a timer for controlling the bypass valve. Various control algorithms are provided for the control module with respect to the timer and the fluid bypass valve. The provided thermal management systems yield a vehicle powertrain with improved thermal management and fuel efficiency.

While the exemplary systems are discussed with respect to conventional powertrains (e.g., having an internal combustion engine and automatic/manual transmissions) other powertrains are compatible with the disclosed thermal management systems. For example, powertrains having a fuel cell, battery pack, continuously variable transmission or electrically variable transmission can be utilized with the present thermal management systems. Moreover, while the examples teach thermal management through regulation of coolant flow between the engine heater core and the transmission fluid warmer, the circulation of any fluid through various system components can be manipulated to achieve the desired heating results as discussed herein. Such fluids include, for example, engine oil, driveline lubricants or axle oil.

Referring now to FIG. 1, there is shown therein a vehicle powertrain 10 with a thermal management system 20. The powertrain 10 includes an engine 30 such as an internal combustion engine. The engine 30 is in thermal communication with a heater core 40. The heater core 40 receives heat from the engine 30 when the engine is operating and uses this thermal energy for the vehicle heating ventilation and air conditioning system (or HVAC). Heated coolant flows from the engine 30 and is passed through the tubing 50 in the heater core 40. The engine 30 is also in thermal communication with a radiator 60. The radiator 60 is configured to cool the engine 30 by passing a liquid coolant through the engine block. The shown radiator 60 includes an in-tank transmission oil cooler (or "iTOC") 70 used for cooling the transmission during operation.

There is shown a thermostat 80 positioned between the fluid return channel 90 extending from the radiator 60 to the engine 30. Thermostat 80 is a valve configured to react to changes in engine coolant temperature. Thermostat 80 is a stand-alone valve. Radiator 60 also provides thermal cooling to a transmission 110 through the iTOC 70 in line 120. An auxiliary bypass valve 130 is positioned between the radiator 60 and the transmission 110. Fluid flows between the radiator 60 and auxiliary bypass valve 130 through lines 125 and 135. The auxiliary bypass valve 130 selectively allows fluid to flow between the radiator 60 and the transmission 110. When the bypass valve 130 is activated fluid is distributed to the transmission 110, when the bypass valve is deactivated fluid is recycled back to the radiator 60 through line 135. In this embodiment, the auxiliary bypass valve 130 is activated when the transmission fluid is so low that cooling is not desired. An example of a temperature reading for the transmission fluid is 180 degrees Fahrenheit. The shown transmission 110 is an automatic transmission.

A temperature sensor 140 is also included in the transmission 110, as shown in FIG. 1. Sensor 140 is also in communication with the control module 100, which is configured to control certain components in the thermal management system 20, in part, based on the thermal readings from temperature sensor 140. In another embodiment, temperature sensor 140 is included in the oil pan of the transmission. In another embodiment, temperature sensor is included in the transmission box.

Downstream of an exhaust line 150 of the transmission a transmission fluid warmer 160 is also provided in the thermal management system 20. The warmer 160 is a heat exchanger. Transmission fluid warmer 160 is in fluid communication with an oil cooler 170. Oil cooler 170 cools engine oil. The warmer 160 is selectively in thermal communication with the heater core 40 through a (primary) bypass valve 190; fluid flows therebetween through line 180. Bypass valve 190 is positioned between the heater core 40 and the transmission fluid warmer 160 and is configured to control the flow of fluid therebetween. When the bypass valve 190 is activated fluid from the heater core 40 is re-directed away from the transmission fluid warmer 160 and recycled through a pump in the engine 30. When the bypass valve 190 is deactivated fluid flows from the heater core 40 to the automatic transmission fluid warmer 160. In this manner, thermal energy is taken away from the coolant and HVAC (not shown) and passed on to the transmission fluid warmer 160. The bypass valve 190 is linked to control module 100, which is configured to control the bypass valve. Control module 100 can be any number of vehicle control modules. For example, in one embodiment the control module 100 is a climate control module configured to control the vehicle HVAC. In other embodiments, the control module 100 is a powertrain control module, engine control unit and transmission control module.

Figure 2:
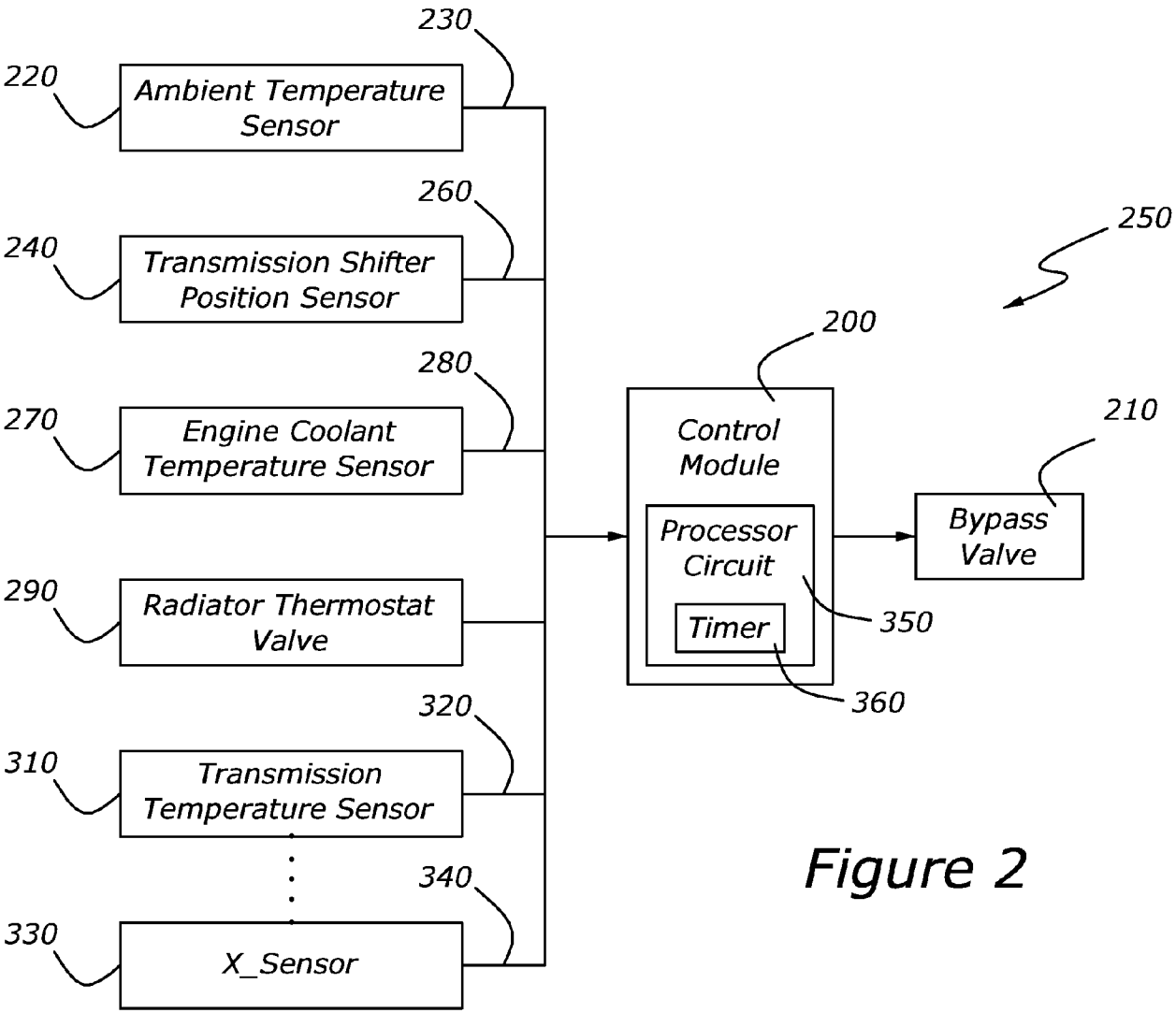
FIG. 2 illustrates a thermal management system according to an exemplary embodiment of the present invention.

Referring now to FIG. 2, there is shown therein an exemplary control module 200 for use with a powertrain thermal management system. Control module 200 is configured to at least control a bypass valve 210 positioned between a heater core and a transmission fluid warmer. Control module 200 is designed to place various limitations on the operation of bypass valve 210. In the shown embodiment, control module 200 is configured to place temporal limitations on the operation of the bypass valve 210. Said temporal limitations can be based on any number of conditions including vehicle performance characteristics.

As shown in FIG. 2, control module 200 is linked to various vehicle systems through sensors configured to take measurements of vehicle performance characteristics. An ambient temperature sensor 220 is provided and linked to the control module 200 at connection 230. Ambient temperature readings of the starting temperature of powertrain system components can be directly measured or inferred. For example, after the vehicle has been resting outdoors overnight, the powertrain system components will be at the same temperature as the ambient. The ambient temperature reading can provide information on the temperature differential between the actual and desired temperatures for system components. The sensor 220 can be placed anywhere with respect to the vehicle. For example in one embodiment, the sensor 220 is in communication with the operator control panel and/or the vehicle HVAC system for other user functions.

A transmission shifter position sensor 240 is also provided in the thermal management system 250 of FIG. 2. The transmission shifter position sensor 240 is linked to the control module 200 through connection 260. The transmission shifter position sensor 240 can be linked to or incorporated into the transmission control unit (not shown). Sensor 240 is configured to determine the mode of transmission operation. Such mode can include, but is not limited to, the gear of operation and/or whether the transmission is in reverse, drive or park. In another embodiment, the mode of transmission operation relates to the frequency or infrequency of clutch engagement for a given transmission. In some instances, the mode of transmission operation can be linked to the thermal needs of the transmission and/or powertrain. For example, in higher gears of operation the rate of heating the transmission is much greater than in lower gears. The thermal management needs of the system thus change.

An engine coolant temperature sensor 270 is also provided and linked to the control module 200 of FIG. 2. The engine coolant temperature sensor 270 is linked to the control module 200 through connection 280. The engine coolant temperature sensor 270 is configured to take actual temperature readings of engine coolant before, during or after cycling through the engine. An exemplary engine coolant temperature sensor 270, as shown in FIG. 1, is positioned before the coolant cycles through the engine. The engine coolant temperature can provide an accurate reading of the engine temperature, particularly when the sensor 270 is positioned in between the engine and radiator or inside the engine.

The thermal management system of FIG. 2 also includes a radiator thermostat valve 290. The radiator thermostat valve 290 is thermally actuated, configured to open and close in response to engine coolant temperature. A waxed motor or bimetal actuator, for example, can be used in the valve. When it is desirable to warm the engine 30, the radiator thermostat valve 290 can be closed and the radiator disconnected from the engine. The radiator 60 can be used to cool engine coolant when the radiator thermostat valve 290 is at least partially open.

A transmission temperature sensor 310 is also provided and linked to the control module 200 of FIG. 2 through connection 320. The transmission temperature sensor 310 is located in the transmission and configured to take actual temperature readings of transmission.

Any number of sensors can be linked to the control module 200 for use with the thermal management system. "X_Sensor" 330 is a sensor representing any number of exemplary sensors that can be included in the system. Sensor 330 connects with the control module 200 through connection 340. Sensor 330 can be configured to monitor HVAC activity. Another sensor can be coupled to the engine control unit to determine a mode of engine operation. For example, in displacement-on-demand engines, sensor can be configured to determine the number of cylinders utilized by the engine. Other sensors, such as viscosity sensors, speed sensors, fluid level monitors and other devices can be utilized with the thermal management system.

Though the links shown between sensors are described in terms of hardwired connections, any one of the sensors can be wirelessly linked to the control module. Bluetooth technology, configured to enable short-range communication between electronic devices, is utilized to enable the sensors to communicate with the control module wirelessly. Other wireless standards or technologies can be used with the thermal management system such as infrared systems, RF systems, IEEE standard 802.11 and other communications platforms.

Control module 200, as shown in FIG. 2, includes a processor circuit 350 and a timer 360 that is incorporated in the processor circuit. The processor circuit 350 includes control logic for governing the activation and deactivation of the bypass valve 210. Bypass valve 210 is similar to the valve 190, as shown in FIG. 1, positioned between the heater core 40 and the transmission fluid warmer 160 and is configured to selectively control the flow of fluid therebetween. Processor circuit 350, as shown in FIG. 2, can include various algorithms for controlling the bypass valve 210. In this embodiment, processor circuit 350 includes control logic that governs the bypass valve 210 with temporal limitations on the operation of the bypass valve. Timer 360 executes the temporal limitations. In one embodiment, timer 360 is configured to delay deactivation of the bypass valve 210 in a set time period based on sensed vehicle performance characteristics. Though, in the shown embodiment of FIG. 2 timer 360 is shown inside of the processor circuit 350, timer can be positioned outside of the control module and/or incorporated into the bypass valve 210. Timer 360 can be, for example, a digital or analog counter.

Figure 3B:
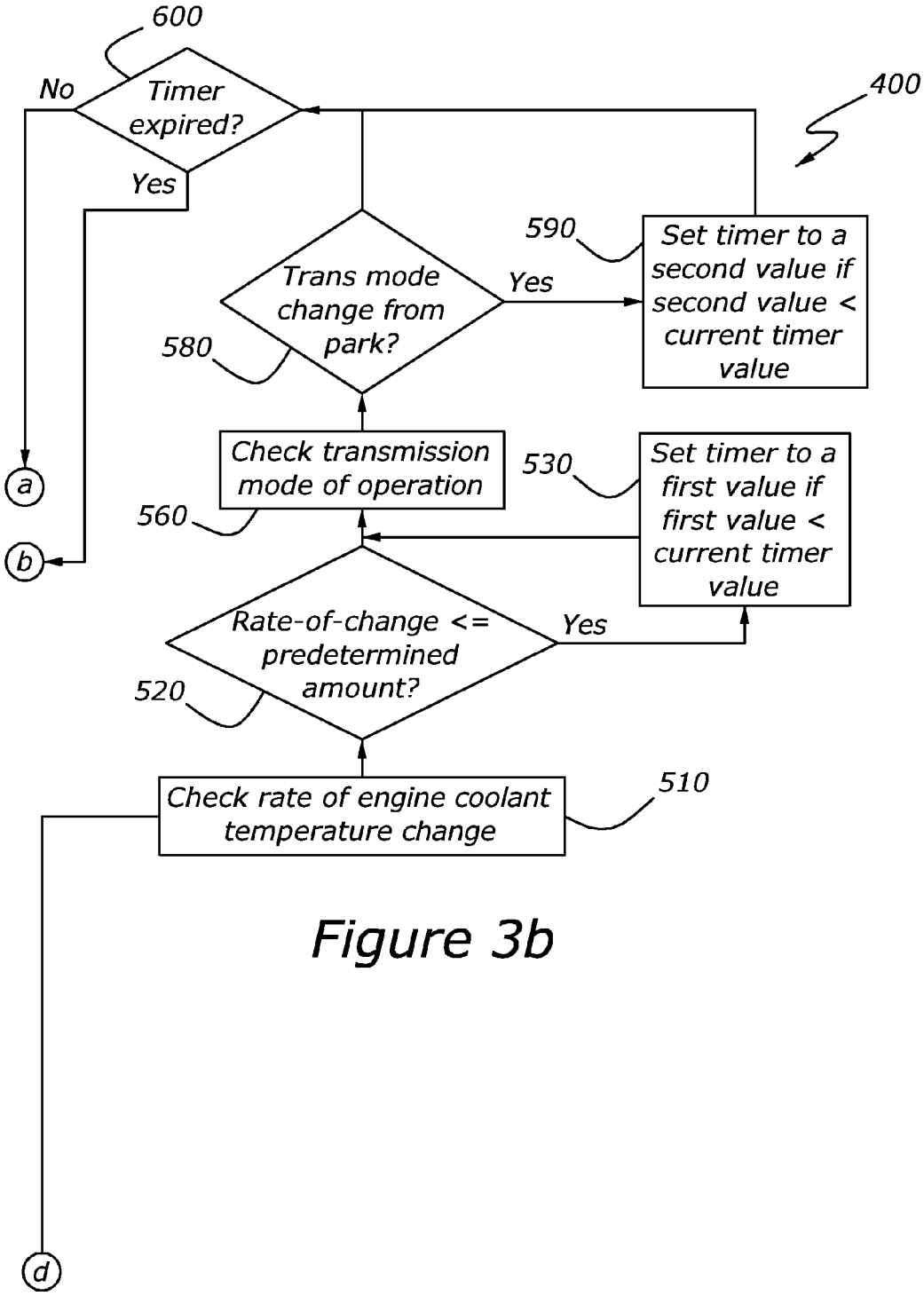

Referring now to FIGS. 3*a-b*, there is shown therein control logic 400 for an exemplary thermal management system. The control logic 400 illustrates one algorithm by which the thermal management system can operate to control the bypass valve with temporal limitations.

The control logic 400 initiates the operating sequence for the control module when the vehicle engine is turned on at 410. As soon as the engine is started the control module enters into a series of system checks or assessments for various vehicle performance characteristics. First, the control module communicates with an ambient temperature sensor at 420 to determine the ambient temperature during start up. Ambient temperature readings can be measured or inferred from various system components, such as for example, the engine coolant temperature, transmission oil temperature, or the air intake line during vehicle startup. The ambient temperature is compared to a predetermined temperature at 430. Where the ambient temperature is above a predetermined amount the operating sequence for the control module ends 440. This can more often be the case in warmer climatic environments such as Florida and Arizona, where even after sitting overnight the powertrain can be sufficiently warm to not require the use of the heater core. An exemplary threshold temperature for ending the operating sequence can be, for example, 50 degrees Fahrenheit. If the ambient temperature is less than a predetermined amount, the control module moves to the next step which is activation of the bypass valve at 450. Alternatively the module can progress from engine turn on 410 and proceed directly to step 450 (activating the bypass valve as soon as the engine is started).

After the bypass valve is activated 450, as shown in FIG. 3*a*, the control logic stores a predetermined value in a timer or timers included in the thermal management system at step 455. Though timers are not activated at step 455 in the illustrated embodiment, timers store a value from which timers countdown once activated. An exemplary default value at startup for timers can be 10 minutes.

The module next checks the engine coolant temperature at 460. Control module communicates with an engine coolant temperature sensor to obtain a reading of the engine coolant temperature. The engine coolant temperature is compared to a predetermined temperature at 470. If the engine coolant temperature is greater than a predetermined amount the bypass valve is deactivated at 480. Where the engine is sufficiently warm, heat can be added to the transmission fluid warmer without infringing on the thermal needs of the rest of the system. If the engine coolant temperature is less than a predetermined temperature, the control module continues in the operation sequence. An exemplary threshold temperature for engine coolant can be, for example, 190 degrees Fahrenheit.

Continuing through the operating sequence, as shown in FIG. 3*a*, the control module next checks the transmission operating temperature 490. Control module communicates with a transmission fluid temperature sensor to obtain a reading of the transmission fluid temperature. The transmission temperature is compared to a predetermined temperature at 500. If the transmission fluid temperature is greater than a predetermined amount the bypass valve is deactivated at step 480. Where the transmission is too warm, the bypass valve need not be activated for transmission coolant cooling. If the transmission fluid temperature is less than a predetermined temperature, the control module continues in the operation sequence. An exemplary threshold temperature for transmission fluid can be, for example, 200 degrees Fahrenheit.

Next the control module assesses the rate of engine coolant temperature change 510, as illustrated in FIG. 3*b*. Control module communicates with an engine coolant temperature sensor to obtain a number of readings of the engine coolant temperature over time. The processor circuit then calculates the rate of change of the engine coolant temperature. The rate of change of the engine coolant temperature is compared to a predetermined value at 520. Where the rate of change of engine coolant temperature is less than or equal to a predetermined amount the timer can be set to a first value 530. Timer is configured to implement a timed deactivation of the bypass valve. Timers are set by default to a stored valve (at step 455) such as 10 minutes. An exemplary threshold rate of change of engine coolant temperature can be, for example, one degree Fahrenheit per second. This rate of change can be an indicator, indicating that the radiator thermostat valve is beginning to open up or at least partially open. The control module is configured to detect this indicator and set the timer when this indicator is detected. The timer is then set for deactivation of the bypass valve at a time that is sooner than the default value. An exemplary time setting for the timer is 10 minutes after the rate of change in engine coolant temperature is less than or equal to one. After the expiration of the predetermined time, the control module deactivates bypass valve as shown at 480.

Continuing through the operating sequence, as shown in FIG. 3*b*, the control module next checks the transmission mode of operation 560. A transmission shifter position sensor is in communication with the control module. The control module determines whether the transmission is in a non-park mode of operation 580, e.g., drive or reverse. Control module is configured to set the timer to a second value 590 if the transmission is not in park. The timer is then set for deactivation of the bypass valve to a second value only if the value that is lower than the current value on the timer. An exemplary time setting for the timer is 10 minutes after the transmission is shifted out of park. Multiple timers can also be included in the thermal management system. Where the system includes more than one timer the control logic independently activates each timer when the assigned predetermined condition is met. Deactivation of the bypass valve is governed by which ever timer expires first.

After the expiration of the predetermined time, the control module deactivates bypass valve as shown at 480. At step 600 the control module checks to see if the timer is expired. Where the timer is expired the control module automatically deactivates the bypass valve at step 480. If the timer has not expired the control module continues through the operating sequence to step 460 (checking the engine coolant temperature). Control module continues through this sequence until either the bypass valve is deactivated through the timer after the time therein has expired or another condition that directly deactivates the bypass valve is met. This time delayed deactivation of the bypass valve better manages the tradeoffs between thermal management and fuel efficiency of the vehicle powertrain.

The vehicle performance characteristics and other criteria, discussed with respect to FIGS. 3*a-b*, used to control the bypass valve are preset values. All of the discussed numeric values are intended to be exemplary values that can be adjusted. The values can be calibrated according to different powertrains, vehicles, driving environments or other settings.

Figure 4:
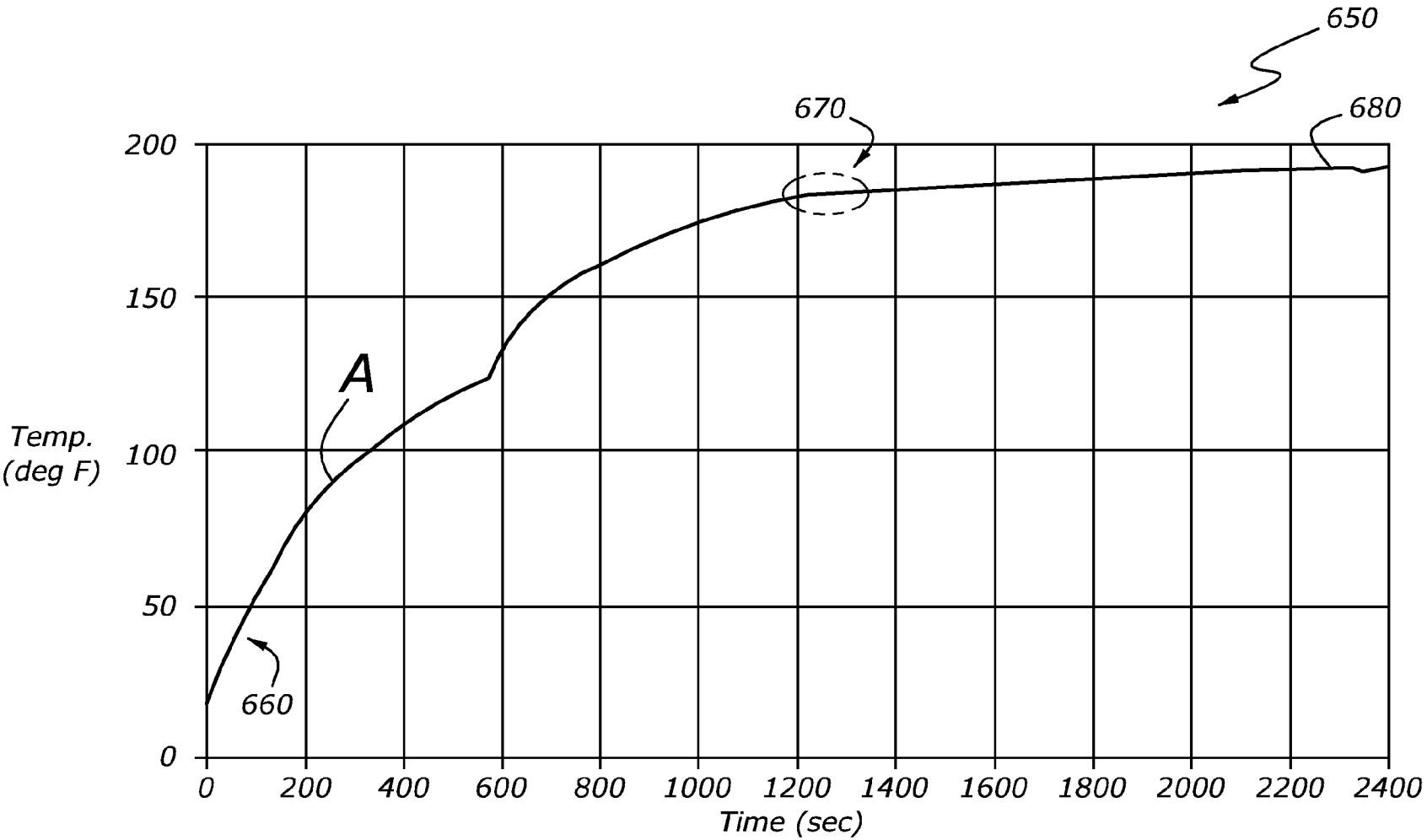
FIG. 4 illustrates a graph of empirical data of engine and transmission temperatures over time.

FIG. 4 illustrates a graph 650 of empirical data of engine and transmission temperatures over time. An exemplary control module is configured to control a bypass valve according to measured data from the engine coolant and transmission operating temperature. Line A is an exemplary curve showing the temperature of engine coolant over time (in seconds). When the engine initially starts, at time equal to zero 660, the rate of engine coolant temperature change is high and Line A has a steep curve. The rate of change progressively decreases. At point 670 the rate of change for the engine coolant temperature is approximately one degree per second. A control module, e.g., as discussed with respect to FIGS. 2-3*b*, can be configured to set the timer for deactivation of the bypass valve when this phenomenon is detected. As the engine continues to operate the rate of change decreases and the engine coolant temperature begins to level off, e.g., at point 680. A control module, e.g., as discussed with respect to FIGS. 2-3*b*, can be configured to set the timer for deactivation of the bypass valve when the rate of change of engine coolant temperature over time approaches zero. Control module can also detect or approximate when a radiator thermostat valve is beginning to open from the engine coolant temperature curve. A rate of change in engine coolant temperature over time can be an indicator, indicating that the radiator thermostat valve is beginning to open up or at least partially open. The control module is configured to detect this indicator and set a timer accordingly.

Figure 5:
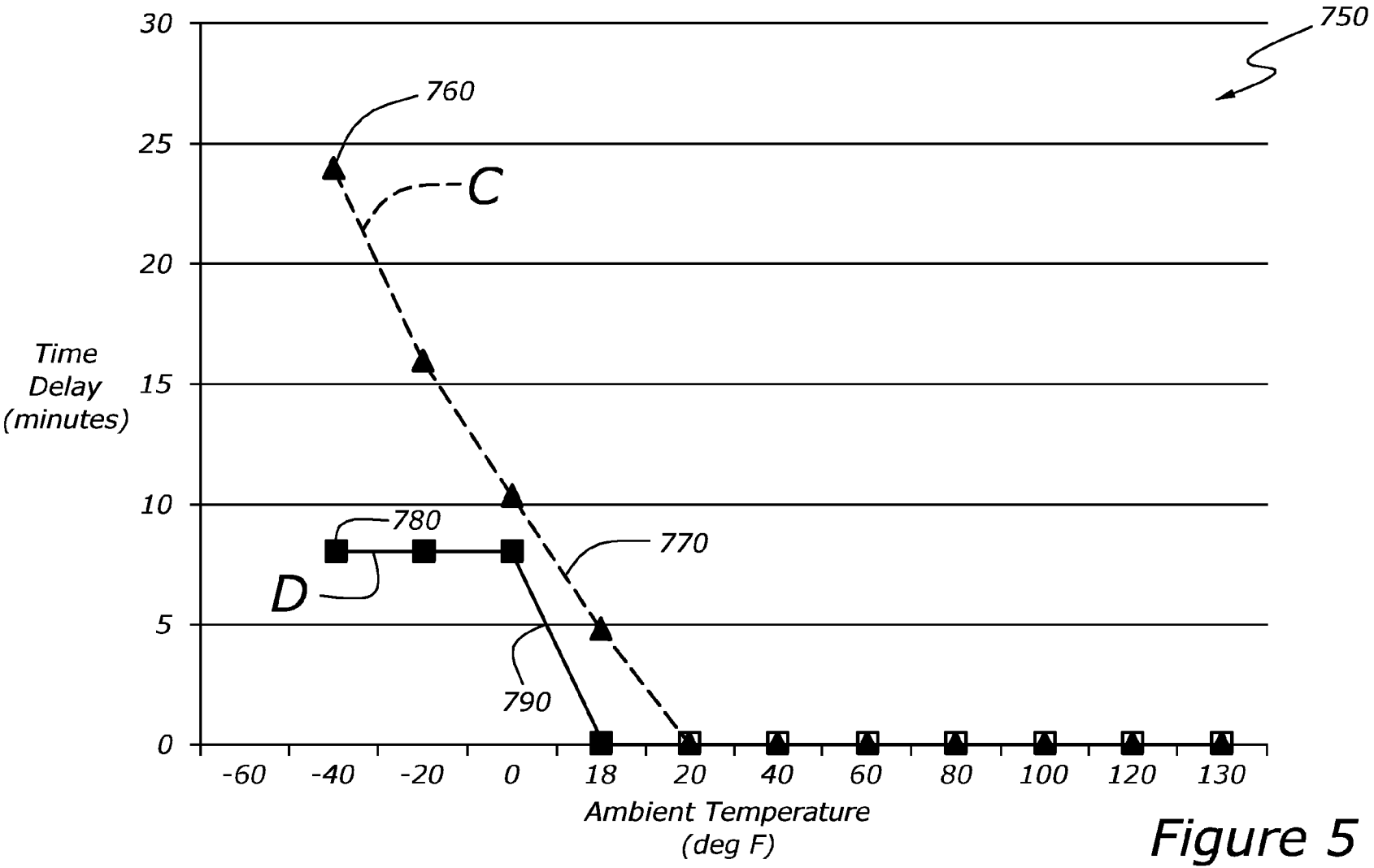
FIG. 5 illustrates a graph of two exemplary timer-setting algorithms for a powertrain thermal management system.

FIG. 5 illustrates a graph of two exemplary timer-setting algorithms for a powertrain thermal management system. The algorithm for the control module is configured to set the deactivation timer for the bypass valve according to temperature readings from a temperature sensor taken at vehicle startup. The sensor can be for the engine coolant temperature at startup (for example). The algorithms illustrated in FIG. 5 are not necessarily executed in the order discussed nor are not necessarily a part of the same control module, e.g., as described in FIGS. 3*a-b*. Line C graphically illustrates a control function that activates a first timer after the transmission is shifted out of park. Temporal limitations are set for the deactivation of a bypass valve according to ambient temperature readings at startup (for example, as discussed with respect to step 455 in FIG. 3*a*). Where the engine coolant temperature is −40 degrees Fahrenheit, the deactivation timer is set to 23 minutes as shown at 760. If the engine coolant temperature is higher at startup, the time delay for deactivation of the bypass valve decreases. For example, where the engine coolant temperature is at or above 9 degrees Fahrenheit at startup, the deactivation timer is set to 7 minutes as shown at 770. The bypass valve is deactivated if the engine coolant temperature is measured at a temperature higher than 20 degrees Fahrenheit at startup.

Line D, as shown in FIG. 5, graphically illustrates a control function that activates a second timer after a predetermined rate of change in engine coolant temperature over time is detected, e.g., two degrees per second. Temporal limitations are set for the deactivation of a bypass valve according to ambient temperature readings derived from the engine coolant temperature at startup (for example, as discussed with respect to step 455 in FIG. 3*a*). Where the ambient temperature is below zero degrees Fahrenheit at startup, the deactivation timer is set to seven minutes as shown at 780. The timer delay is constant for any temperature readings below zero degrees Fahrenheit. As the starting engine coolant temperatures increase the time delay for deactivation of the bypass valve decreases. For example, where the engine coolant temperature is at or above 9 degrees Fahrenheit at startup, the deactivation timer is set to 5 minutes as shown at 790. The bypass valve is deactivated if the engine coolant temperature is measured at a temperature higher than 10 degrees Fahrenheit in the shown embodiment.

The control logic for the module can progressively control the time settings for the timer. Other exemplary embodiments include, for example, timer settings that perform as a step-function. Threshold temperatures are set and the timer setting is changed once the measured temperature exceeds each threshold amount.

Figure 6:
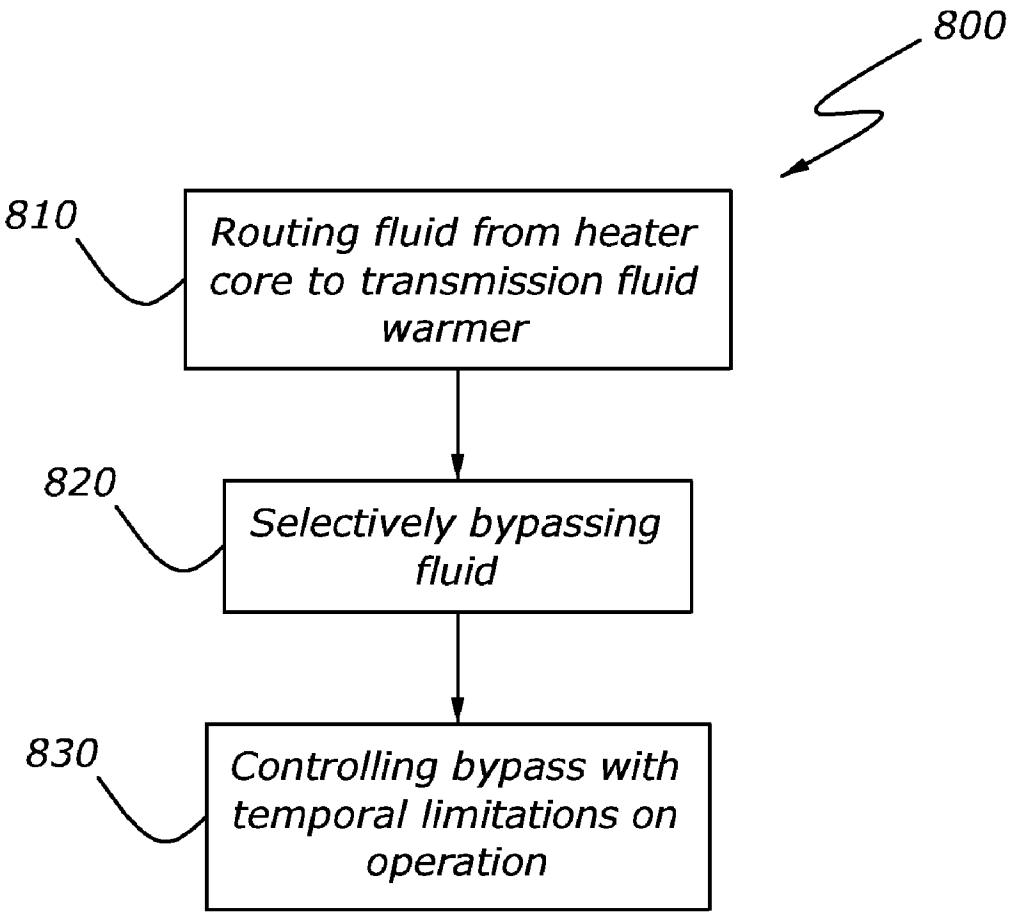
FIG. 6 is a flow chart of a method of heating transmission fluid in a vehicle.

Referring now to FIG. 6, there is shown therein a method 800 of heating transmission fluid in a vehicle. The method includes the steps of: routing fluid from a heater core to the transmission fluid warmer 810; selectively bypassing the fluid from the heater core 820; and controlling bypass of the fluid with temporal limitations on the operation of a bypass valve 830. At least one temporal limitation is related to a vehicle performance characteristic, e.g., the engine coolant temperature or the transmission temperature. The method 800 can be executed, for example, using software as discussed with respect to the embodiments discussed in FIGS. 1-3*b*. Other means for executing the method include electrical hardware, mechanical components and other devices.

In another embodiment, the method 800 of heating transmission fluid in a vehicle further includes providing a processor linked to various vehicle systems. The processor is configured to control the bypass valve (for example, as shown and discussed with respect to the examples in FIGS. 1-3*b*). The method further includes providing a timer configured to implement at least one of the temporal limitations on the operation of the bypass valve.

It will be apparent to those skilled in the art that various modifications and variations can be made to the methodologies of the present disclosure without departing from the scope of its teachings. Other embodiments of the invention will be apparent to those skilled in the art from consideration of the specification and practice of the teachings disclosed herein. It is intended that the specification and examples be considered as exemplary only.

While the best modes for carrying out the invention have been described in detail, those familiar with the art to which this invention relates will recognize various alternative designs and embodiments for practicing the invention within the scope of the appended claims.

We claim:

1. A thermal management system for a vehicle powertrain, comprising:

a heater core;

a transmission fluid warmer selectively in thermal communication with the heater core;

a bypass valve between the heater core and transmission fluid warmer configured to control fluid flow therebetween;

a control module configured to control the bypass valve;

a timer linked to the control module, configured to delay deactivation of the bypass valve; and a temperature sensor linked to the control module, configured to assess an engine coolant temperature;

wherein the control module is configured to deactivate the bypass valve when engine coolant temperature is greater than a predetermined amount; and wherein the control module is configured to set the timer when a rate of engine coolant temperature change is less than a predetermined amount.

2. The system of claim 1, wherein the predetermined amount is one degree Fahrenheit per minute.

3. A control module for a transmission thermal management system, comprising:

a processor linked to a vehicle system configured to control a fluid bypass valve between a transmission fluid warmer and a heater core, the processor including:

a timer configured to implement a delayed deactivation of the bypass valve;

wherein the control module is configured to set the timer when an indicator is detected indicating that a radiator thermostat valve is at least partially open.

4. A thermal management system for a vehicle powertrain, comprising:

a heater core;

a transmission fluid warmer selectively in thermal communication with the heater core;

a bypass valve between the heater core and transmission fluid warmer configured to control fluid flow therebetween;

a control module configured to control the bypass valve; and a timer linked to the control module, configured to delay deactivation of the bypass valve;

wherein the control module is configured to set the timer when an indicator is detected indicating that a radiator thermostat valve is at least partially open.

5. A thermal management system for a vehicle powertrain, comprising:

a heater core;

a transmission fluid warmer selectively in thermal communication with the heater core;

a bypass valve between the heater core and transmission fluid warmer configured to control fluid flow therebetween;

a control module configured to control the bypass valve; and a timer linked to the control module, configured to delay deactivation of the bypass valve;

wherein the control module is linked to a transmission shifter position sensor configured to determine a mode of transmission operation; and wherein the control module is configured to set the timer according to the mode of transmission operation.

6. The system of claim 5, wherein the control module is configured to set the timer when the mode of transmission operation is a non-park mode of operation.

7. A control module for a transmission thermal management system, comprising:

a processor linked to a vehicle system configured to control a fluid bypass valve between a transmission fluid warmer and a heater core, the processor including:

a timer configured to implement a delayed deactivation of the bypass valve;

wherein the control module is linked to a temperature sensor and configured to deactivate the bypass valve according to an ambient temperature reading; and wherein the control module is configured to set the timer to deactivate the bypass valve when a rate of engine coolant temperature change is less than a predetermined amount.

8. A control module for a transmission thermal management system, comprising:

a processor linked to a vehicle system configured to control a fluid bypass valve between a transmission fluid warmer and a heater core, the processor including:

a timer configured to implement a delayed deactivation of the bypass valve;

wherein the control module is linked to a transmission shifter position sensor configured to determine a mode of transmission operation and set the timer to deactivate the bypass valve according to the mode of transmission operation.

9. The control module of claim 8, wherein the control module is configured to set the timer when the mode of transmission operation is a non-park mode of operation.

* * * * *